US010060442B2

(12) United States Patent
Mornan et al.

(10) Patent No.: US 10,060,442 B2
(45) **Date of Patent: *Aug. 28, 2018**

(54) MIXED FLOW FAN ASSEMBLY

(71) Applicant: Dyna-Tech Sales Corporation, Branchburg, NJ (US)

(72) Inventors: Brian J. Mornan, Basking Ridge, NJ (US); Frank J. Beitz, Flemington, NJ (US); Nicholas J. Almerini, North Haledon, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 232 days.

This patent is subject to a terminal disclaimer.

(21) Appl. No.: 15/187,432

(22) Filed: Jun. 20, 2016

(65) Prior Publication Data

US 2016/0290348 A1 Oct. 6, 2016

Related U.S. Application Data

(63) Continuation-in-part of application No. 14/062,311, filed on Oct. 24, 2013, now Pat. No. 9,371,836.

(51) Int. Cl.

| | |
|---|---|
| ***F04D 29/54*** | (2006.01) |
| ***F04D 29/44*** | (2006.01) |
| ***F04D 29/38*** | (2006.01) |
| ***F04D 25/08*** | (2006.01) |
| ***F04D 17/06*** | (2006.01) |
| ***F04D 29/42*** | (2006.01) |

(52) U.S. Cl.

CPC ..... *F04D 29/542* (2013.01); *F04D 17/06* (2013.01); *F04D 25/082* (2013.01); *F04D 29/384* (2013.01); *F04D 29/4213* (2013.01); *F04D 29/4226* (2013.01); *F04D 29/441* (2013.01); *F04D 29/444* (2013.01); *F04D 29/544* (2013.01); *F05D 2240/304* (2013.01); *F05D 2250/51* (2013.01)

(58) Field of Classification Search

CPC ..... F04D 17/165; F04D 269/384; F04D 269/444; F04D 269/542; F04D 269/544; F24F 7/025

See application file for complete search history.

(56) References Cited

U.S. PATENT DOCUMENTS

| | | | |
|---|---|---|---|
| 3,719,032 | A | 3/1973 | Cash |
| 4,806,076 | A | 2/1989 | Andrews |
| 5,439,349 | A | 8/1995 | Kupferberg |
| 6,112,850 | A | 9/2000 | Secrest et al. |
| 6,431,974 | B1 | 8/2002 | Tetley et al. |

(Continued)

*Primary Examiner* — Peter J Bertheaud

(74) *Attorney, Agent, or Firm* — Thomas J. Germinario

(57) ABSTRACT

A mixed flow fan assembly uses induced reverse ambient air flow through the in-line motor enclosure for motor cooling, motor segregation from primary exhaust contamination, and augmentation of volumetric flow rate. Induced ambient airflow through openings in and/or around the base of the fan housing balances low pressure around the fan wheel and the inlet cone to inhibit primary exhaust recirculation and increase volumetric flow rate. Guide vanes downstream of the fan wheel are used to axially reorient radial and tangential velocity components of primary effluent flow. The geometry of the fan assembly is optimized to minimize exhaust gas recirculation and maximize overall efficiency.

13 Claims, 16 Drawing Sheets

(56) References Cited

U.S. PATENT DOCUMENTS

| | | | | |
|---|---|---|---|---|
| 6,509,081 | B1 | 1/2003 | Diamond | |
| 6,676,503 | B2 | 1/2004 | Hill et al. | |
| 7,241,214 | B2 | 7/2007 | Sixsmith | |
| 7,547,249 | B2 | 6/2009 | Seliger et al. | |
| 9,371,836 | B2 * | 6/2016 | Mornan | F04D 29/542 |

* cited by examiner

MIXED FLOW FAN ASSEMBLY

REFERENCE TO RELATED APPLICATION

This application is a continuation-in-part of U.S. application Ser. No. 14/062,311, filed Oct. 24, 2013, the disclosure of which is incorporated herein by reference.

BACKGROUND OF THE INVENTION

The present invention relates to the general field of inline exhaust fan assemblies, and more particularly to mixed flow fan assemblies.

In a mixed flow fan assembly, the primary exhaust gas/air flow enters the impeller axially, i.e., parallel to the impeller shaft axis, and is discharged from the impeller with both axial and radial velocity components. The objective of the present invention is to provide a mixed flow fan assembly with greater static efficiency and reduced noise output, thereby reducing the energy required to run the fan at an equivalent performance level. The fan assembly described herein is designed to operate upstream of a discharge nozzle, such as the induction nozzle described in U.S. patent application Ser. No. 13/067,269, the disclosure of which is incorporated herein by reference.

Because of the geometry of prior art designs, specifically the relatively large fan wheel (impeller) shroud angle with respect to a vertical reference line, impeller blade positioning, inlet bell design and positioning, and impeller offsets, discharging primary airflow (i.e. air that enters through the inlet bell) will recirculate through the fan wheel. The air is processed through the fan wheel, and as it discharges the fan wheel, a portion of the total primary flow recirculates back through the impeller offset (between the inlet bell and the impeller shroud) to be reprocessed by the fan wheel (impeller). A separate portion of the primary flow continues in suspended rotation in the space between the exterior of the inlet bell and the interior of the fan housing in the direction of impeller rotation. This recirculation reduces efficiency by reducing the total flow capacity of the impeller by the portion of airflow that is recirculated by the impeller.

Moreover, in the annular exhaust plenum relatively short axial guide vanes are employed that are typically mounted a substantial distance from the impeller discharge. While there must be adequate space between the bottom of the guide vanes and the trailing edge of the impeller blades to allow the airflow to develop as it discharges the rotating impeller, too much separation between the guide vanes and the impeller discharge leads to highly rotational flow and the development of vortices/turbulence in the annular exhaust plenum, which consumes available energy and reduces overall efficiency.

SUMMARY OF THE INVENTION

The following definitions apply to terms used in this specification and in the claims which follow, and are illustrated with reference to FIGS. 2, 5B, 12 and 14:

"Impeller Diameter" 40, represented by "D", is the distance from the fan housing centerline 57 to the outermost tip of the impeller blades (flights) 20.

"Impeller Shroud ID" 43 is the inner diameter through which the primary exhaust flow enters the fan wheel (impeller) shroud 19.

"Impeller Shroud OD" 42 is the outer diameter through which the primary exhaust flow discharges from the impeller shroud 19.

"Impeller Shroud OD Edge" 36 comprises the points at the impeller shroud OD at which the impeller shroud terminates.

"Impeller Shroud ID Entry Wedge" 44 is the substantially straight vertical portion of the impeller shroud 19 at the impeller shroud ID 43.

"Shroud Transition Curvature 60 is the radius of curvature of the transition between the impeller shroud 19 and the impeller shroud ID entry wedge 44.

"Shroud Curvature Center" 59 is the center location for the shroud transition curvature 60.

"Impeller Cone Plate" 58 is the curved plate that forms the surface of the fan wheel cone 33.

"Impeller Cone Plate OD" 45 is the outer diameter through which the primary exhaust flow discharges from the impeller cone plate 58.

"Impeller Cone Plate OD Edge" 46 comprises the points at the impeller back OD 45 at which the impeller cone plate 58 terminates.

"Flight Leading Edge" 48 is the edge of the impeller blade 20 that impacts flow entering the fan wheel/impeller 18.

"Flight Trailing Edge" 49 is the edge of the impeller blade 20 from which flow discharges from the impeller 18.

"Unified Metacenter" 41, is the point of intersection of a first line, defined by the impeller shroud OD edge 36 and the impeller cone plate OD edge 46, and a second line, defined by the flight trailing edge 49.

"Impeller Discharge Containment Region" 50 is the region upstream of the annular exhaust plenum 16, between the inside of the impeller shroud 19 and the outside of the impeller cone plate 58, and between the flight trailing edge 49 and a horizontal line extending radially outward from the impeller cone plate OD edge 46.

"Inlet Bell ID" 52 is the inner diameter through which the primary exhaust flow exits the inlet bell 14.

"Inlet Bell OD" 51 is the outer diameter through which the primary exhaust flow enters from the inlet bell 14.

"Impeller Offset" 55 is the distance between the impeller shroud ID 43 and the inlet bell ID 52.

"Guide Vane Offset" 56 is the distance between the bottom of the guide vanes 28 and the impeller shroud OD 42.

The present invention modifies the standard design of a mixed flow fan in five ways:

(1) An optimized impeller cone plate design is offered that creates sufficient pressure gradients when the impeller is rotating so as to draw fresh ambient air through a multipurpose port in the fan housing, over a direct drive fan motor, and down into the fan wheel shroud through an aperture at the common centerline. An optional impeller back plate can be included to facilitate the mounting of blades or contours to enhance this cooling effect. This ambient air flow serves three purposes: (a) cooling the fan drive assembly, which is comprised of a motor for direct drive applications or a set of shafts and bearings for belt drive applications, as well as a variable frequency drive (VFD), if present; (b) maintaining positive pressure in the motor enclosure so as to segregate it from potentially contaminated primary exhaust flowing through the annular space around it; (c) diluting the primary effluent and increasing the volumetric flow rate of air/gas exiting the fan discharge, thereby increasing static efficiency.

(2) One or more openings are provided in the base of the fan housing or between the fan housing and the plenum or roof curb on which it is mounted. Fresh ambient air is induced through the opening(s) by the venturi effect of the primary exhaust exiting the fan wheel/impeller shroud. This induced air flow will enter the area surrounding the impeller shroud and the inlet bell and balance the low pressure generated in this region by the increased velocity of the primary exhaust exiting the impeller shroud. Otherwise, this low pressure region will draw some of the primary exhaust from the impeller shroud OD back down below the impeller shroud ID, causing recirculation of a portion of the primary exhaust airstream and consequent loss of efficiency. This recirculation can be characterized by flow discharging the impeller and re-entering the impeller ID to be re-processed and/or flow that discharges the impeller and continues to rotate in the interstitial space between the fan housing interior and the inlet bell exterior. The optimized pressure gradients resulting from the geometry of the present invention serve to minimize primary exhaust recirculation and provide a means to induce fresh ambient air, thereby increasing the overall volumetric flow rate to produce a greater static efficiency per unit input power.

(3) Impeller blades (flights) are designed with airfoil profiles, with an overlap of substrate at the trailing edge creating a single-thickness trailing edge, which can be shaped and/or perforated to reduce operational fan noise.

(4) In order to axially redirect the radial and tangential velocity vectors of the primary exhaust leaving the fan wheel shroud, full length straightening guide vanes are provided in the annular exhaust plenum within the fan housing. Each guide vane transitions from a curved leading edge to a substantially axial trailing edge, thereby transitioning the primary airflow to an axial flow as it exits the fan housing. This reorientation of the primary airflow velocity minimizes turbulence and rotational vortices in the annular exhaust plenum, resulting in a greater volumetric flow rate and increased overall static efficiency of the fan assembly.

(5) The present invention modifies the shroud angle, positioning of the flights, cone plate geometry, inlet bell geometry, and various offsets to minimize exhaust gas recirculation. The geometry serves to optimize dynamic head and static pressure gradients throughout the path taken by the airflow(s). The result is a reduction in the potential for some of the primary airflow to discharge the impeller and recirculate around the rotating impeller shroud and back through the impeller offset to be reprocessed by the impeller, and/or rotate in the direction of the impeller rotation in the space between the exterior of the inlet bell and interior of the fan housing (in polar coordinates defined as a continued rotation about a given angle at a given radius from the fan centerline). The reduction/elimination of recirculated primary air flow improves the fan's ability to use mechanical energy to move a given volume of air and improves efficiency. The impeller discharge containment region, created when the flight training edge of each impeller flight is recessed a prescribed distance from the impeller cone plate OD edge and the impeller shroud OD edge, provides the necessary space within the impeller shroud for the flow to develop as it exits the rotating impeller, thus minimizing the need for an extended space between the impeller cone plate OD edge and the bottom of the guide vanes section. By providing the impeller discharge containment region upstream of the guide vane area, the guide vanes can be moved closer to the rotating impeller, so as to optimize the effect of the guide vanes in axially redirecting the air flow discharged from the impeller. With the end of the guide vanes section being coterminous with the fan discharge, the guide vane length is maximized. The guide vanes can then do a more effective job of minimizing rotational flow, characterized by energy consuming vortices and turbulence, in the annular exhaust plenum. Since the energy expended in the annular exhaust plenum is minimized, more energy can be used to process primary air in the present invention than in prior art, leading to a comparably greater efficiency.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
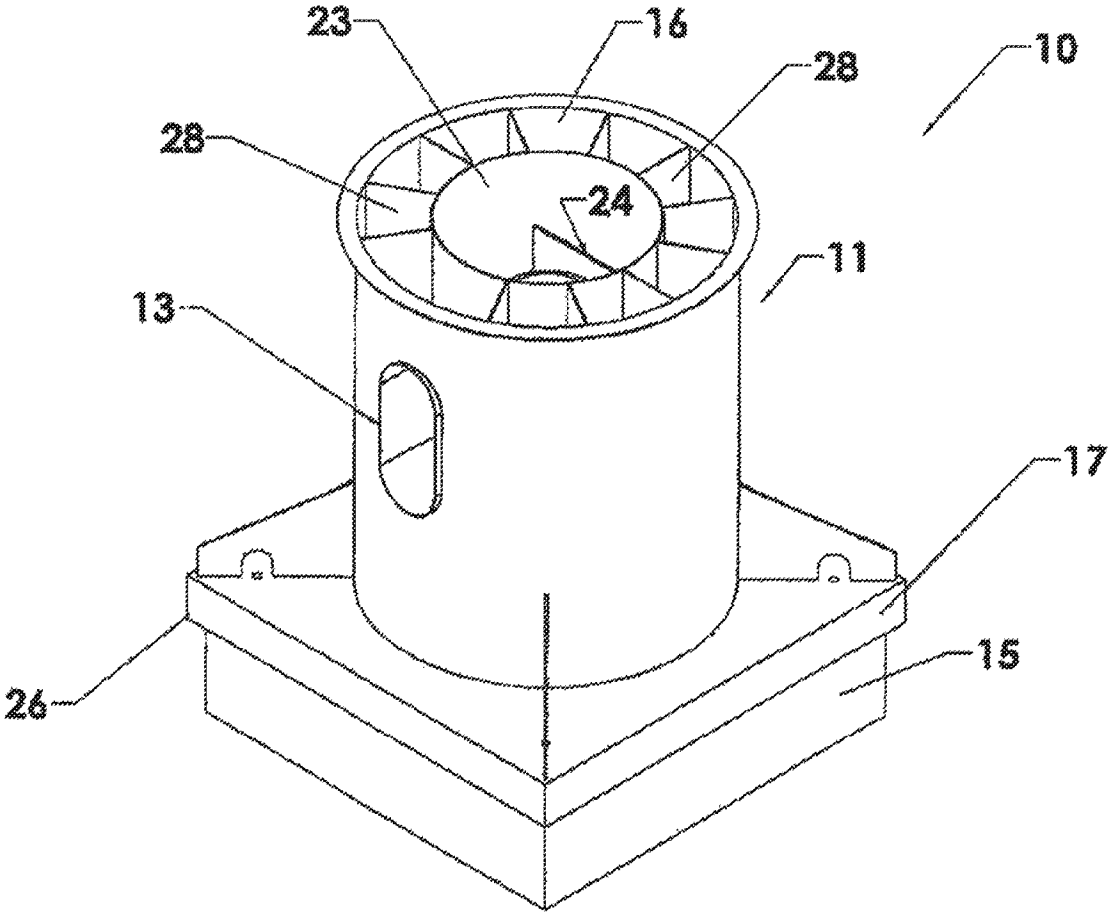
FIG. 1 is a top perspective view of a mixed flow fan assembly according to one embodiment of the present invention.
Figure 2:
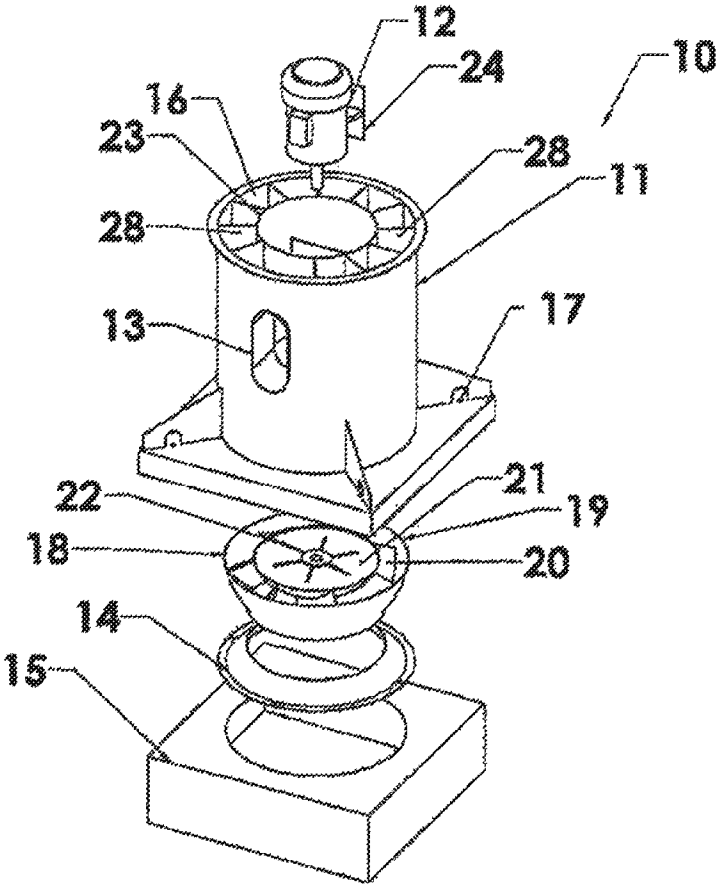
FIG. 2 is a top exploded view of a mixed flow fan assembly according to one embodiment of the present invention.
Figure 3:
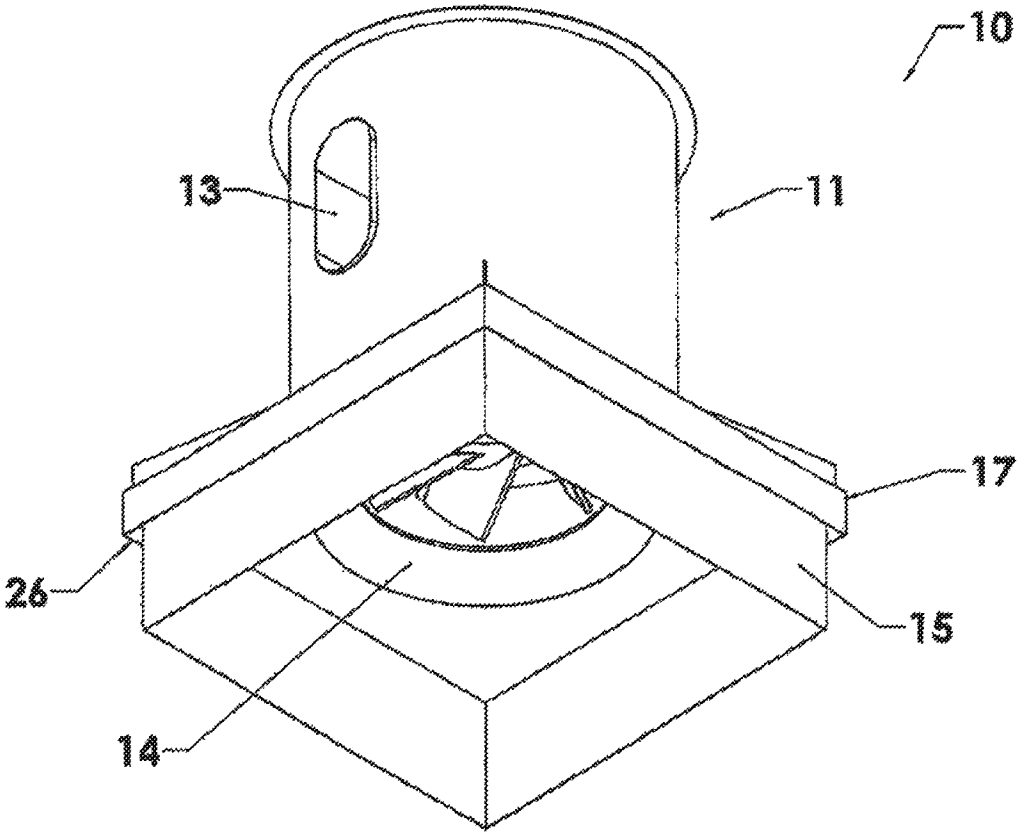
FIG. 3 is a bottom perspective view of a mixed flow fan assembly according to one embodiment of the present invention.
Figure 4:
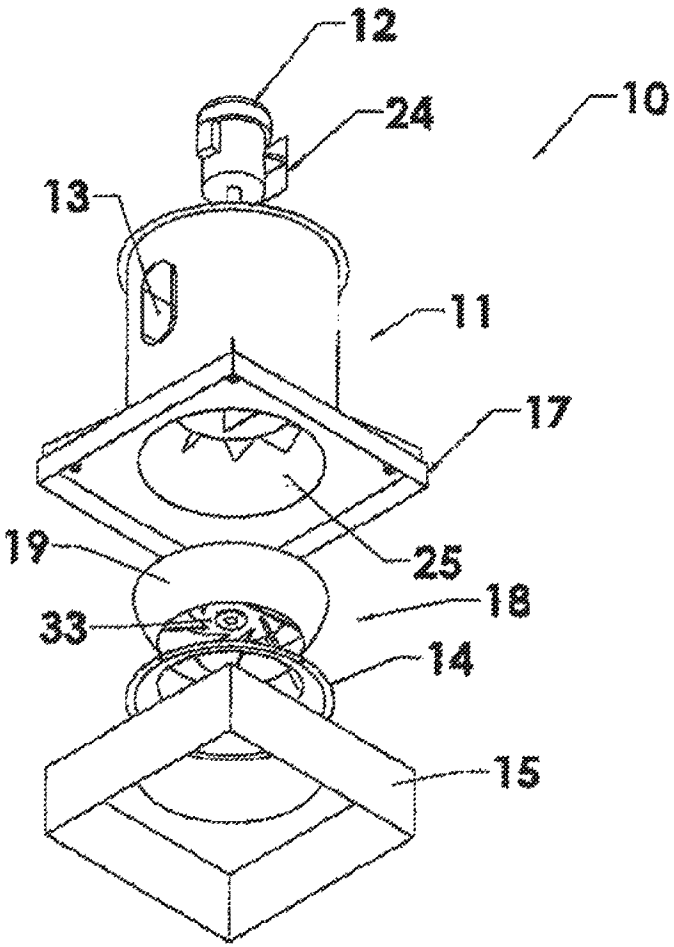
FIG. 4 is a bottom exploded view of a mixed flow fan assembly according to one embodiment of the present invention.
Figure 5A:
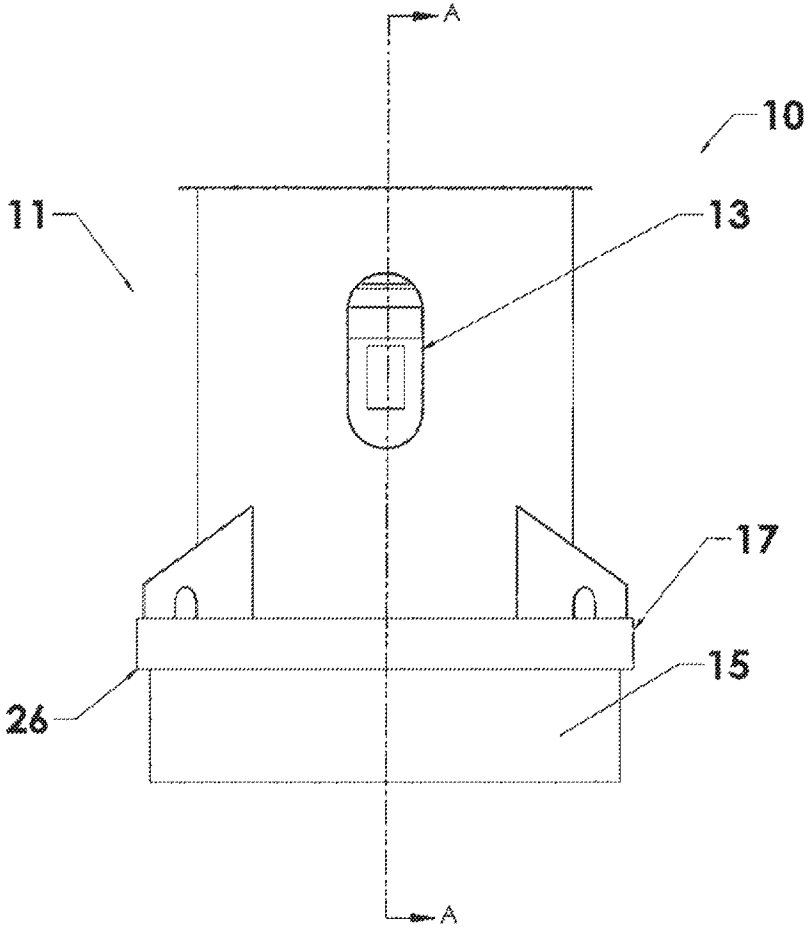
FIG. 5A is a side profile view of a mixed flow fan assembly according to one embodiment of the present invention.
Figure 5B:
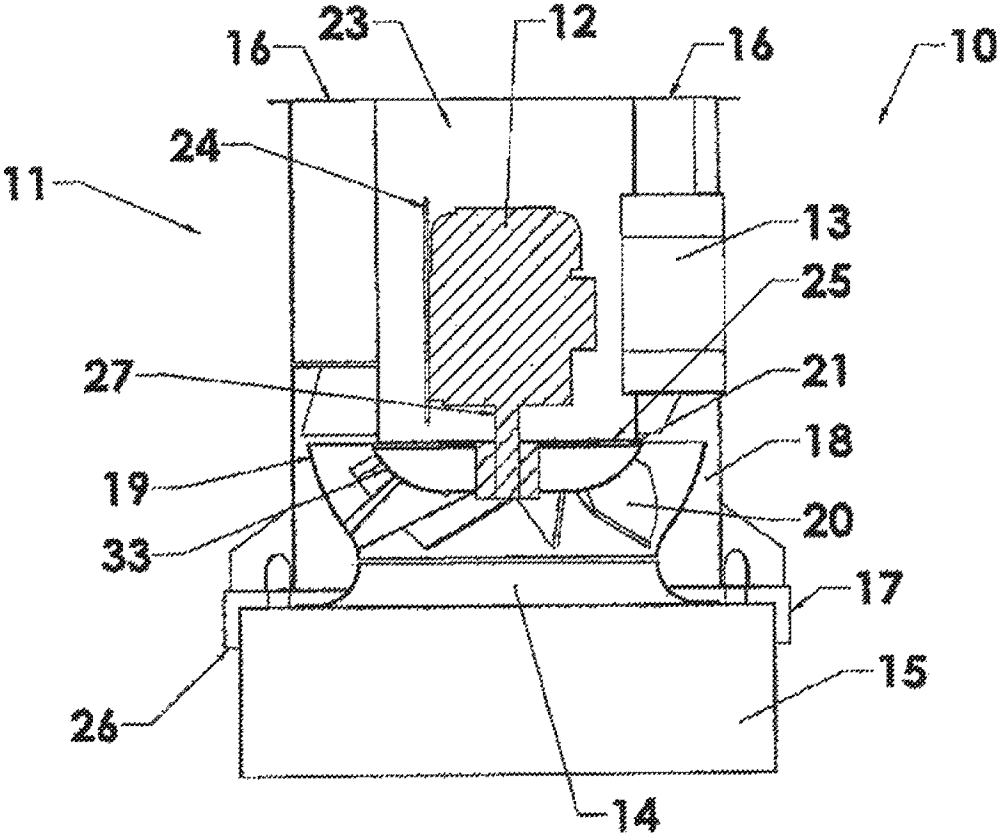
FIG. 5B is an axial cross-section view, along the line A-A in FIG. 5A, of a mixed flow fan assembly according to one embodiment of the present invention.

Referring to FIGS. 1-5B and FIGS. 12-14, an embodiment of a mixed flow fan assembly according to the present invention 10 comprises a cylindrical fan housing 11, the base 17 of which is supported on a mounting plenum (curb) 15. The perimeter of the fan housing base (curb cap) 17 is oversized with respect to that of the mounting plenum 15, so as to leave a peripheral base opening 26, through which ambient air can enter the fan housing 11.

The upper portion of the fan housing 11 is internally divided into an axially central cylindrical motor enclosure 23 surrounded by an annular cylindrical exhaust plenum 16. The motor enclosure 23 contains an in-line fan motor 12, which is mounted on a vertical mounting plate 24, thereby enabling the bottom of the motor enclosure 25 to remain open. A multi-purpose port 13 accesses the interior of the motor enclosure 23 through the exterior of the fan housing 11 and the exhaust plenum 16.

In the lower portion of the fan housing 11 below the motor enclosure 23 is the fan wheel/impeller 18, which comprises an impeller shroud 19, a fan wheel back plate 21, and a wheel cone 33. Multiple impeller blades/flights 20 are attached to both the wheel cone 33 and the impeller shroud 19. The impeller shroud 19 has an inverted bell shape comprising a sphero-conical or hyperbolic section, which opens at its lower end into a substantially frusto-conical or hyperbolic inlet bell 14. The upper opening of the inlet bell 14 (inlet bell OD 51) has a slightly smaller circumference than that of the lower opening of the impeller shroud 19 (impeller shroud ID 43), so that the fan wheel 18 can rotate without interference. The lower end of the inlet bell 14 opens into the mounting plenum (curb) 15, through which the primary exhaust gas/air flows upward into the fan housing 11.

In operation, the fan motor 12 imparts rotation to the fan wheel 18 via a motor-impeller shaft coupling 27. The rotating impeller blades (flights) 20 draw the primary exhaust flow upward through the inlet bell 14 and the impeller shroud 19, from which the exhaust flow is accelerated upward into the annular exhaust plenum 16 and discharges through the top of the fan housing 11.

Referring to FIGS. 5A-7 and FIGS. 13-14, the optional back plate 21 of the fan wheel 18 has a series of radial blades 22, which rotate along with the fan wheel 18. The rotation of the radial blades 22 draws ambient air through the multi-purpose port 13 into the interior of the motor enclosure 23 and downward into the impeller shroud 19 through the open bottom 25 of the motor enclosure 23. In addition to cooling the motor 12, this reverse air flow maintains a positive pressure in the motor enclosure 23 so as to isolate the motor 12 from the potentially contaminated primary exhaust flow through the annular exhaust plenum 16. When this reverse air flow reaches the impeller blades 20, it merges with the primary exhaust, thereby increasing the volumetric exhaust flow rate and enhancing static efficiency, as well as diluting the primary exhaust.

Figure 12:
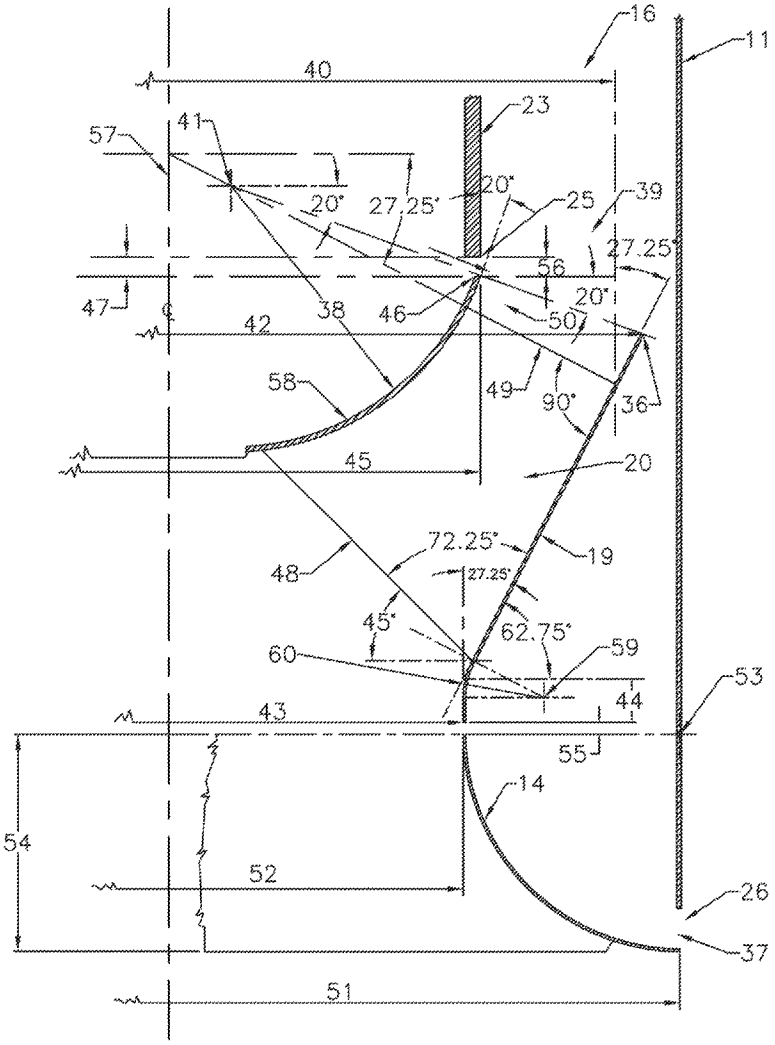
FIG. 12 is a partial detail section view, along the line A-A in FIG. 5A, of a mixed flow fan assembly according to one embodiment of the present invention.
Figure 13:
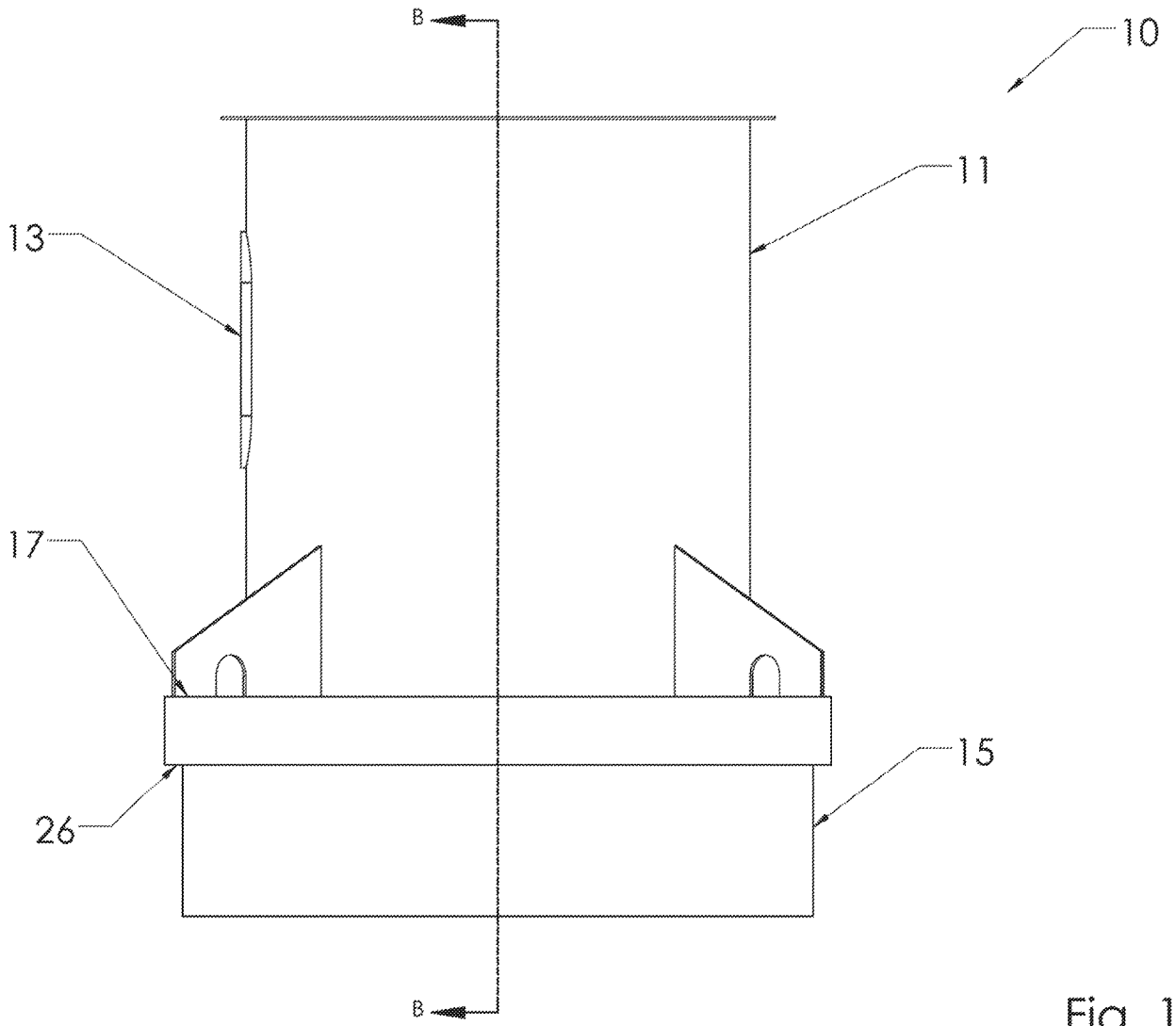
FIG. 13 is a side profile view of a mixed flow fan assembly according to one embodiment of the present invention.
Figure 14:
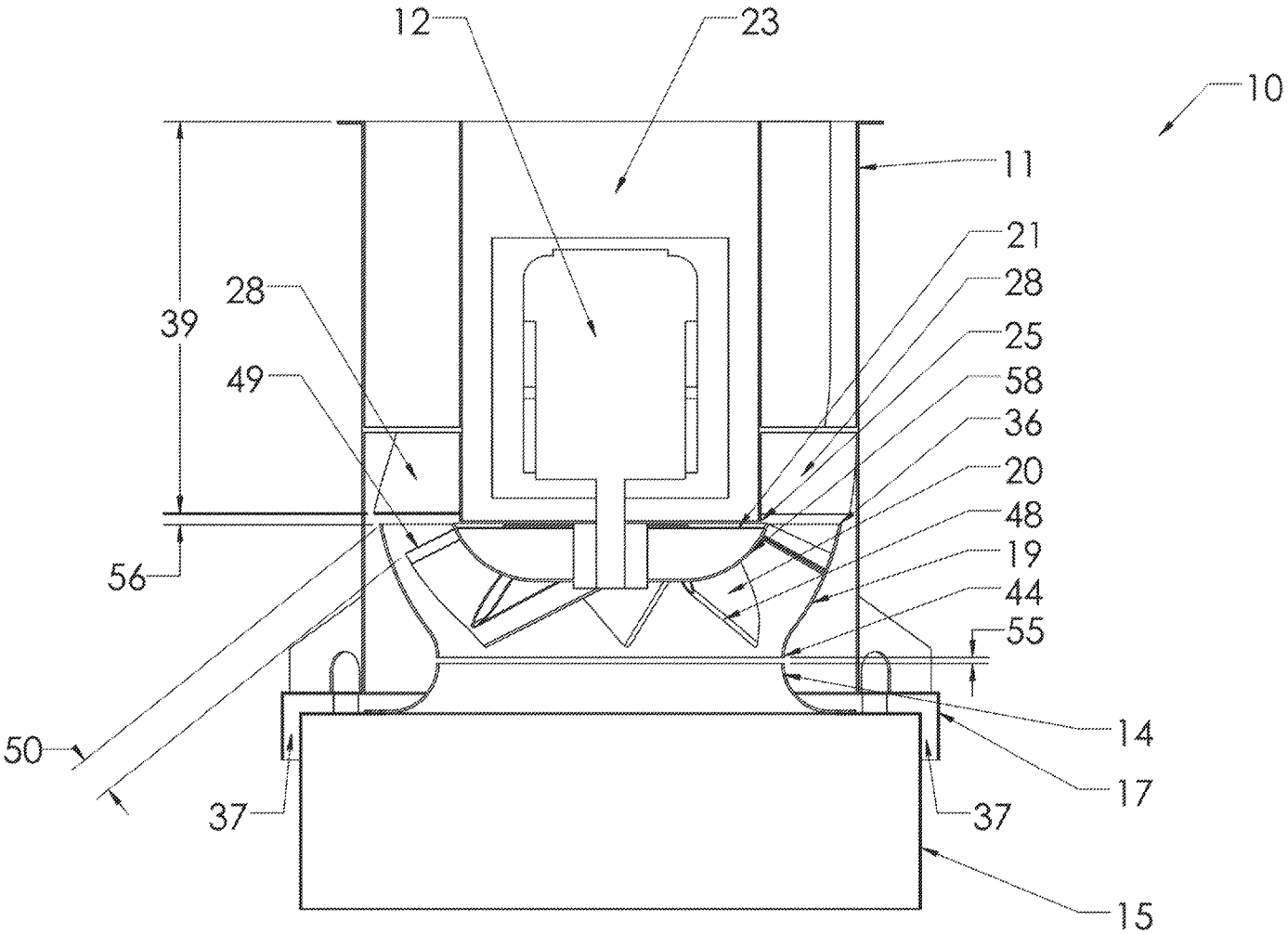
FIG. 14 is an axial cross-section view, along the line B-B in FIG. 13, of a mixed flow fan assembly according to one embodiment of the present invention.

One of the problems with mixed flow fans is that the venturi effect of the exhaust flow exiting from the impeller shroud 19 up into the annular exhaust plenum 16 creates a low pressure region in the lower portion of the fan housing 11 around the exteriors of the impeller shroud 19 and the inlet bell 14 (as best seen in FIG. 12). If not balanced with a positive pressure, this low pressure region tends to draw some of the primary exhaust downward from the exhaust plenum 16 back into the lower opening of the impeller shroud 19 at the impeller offset 55. Such recirculation of primary exhaust flow causes a loss in efficiency.

The present invention 10 addresses this problem by creating openings in and/or around the base (curb cap) 17 of the fan housing 11. In the embodiments illustrated in FIGS. 5B and 12, the gap 26 between the oversized fan housing base (curb cap) 17 and the mounting plenum (curb) 15 operates as an induction port, through which the venturi effect of the primary exhaust exiting the fan wheel shroud 19 draws ambient air 37 into the low pressure region surrounding the impeller shroud 19 and the inlet bell 14. The positive pressure of this induced air flow 37 balances the low pressure in this region and thereby inhibits the recirculation of primary exhaust gases. The induced air flow 37 also has the effect of augmenting the exhaust volumetric flow rate, thus achieving better static efficiency.

Figure 11:
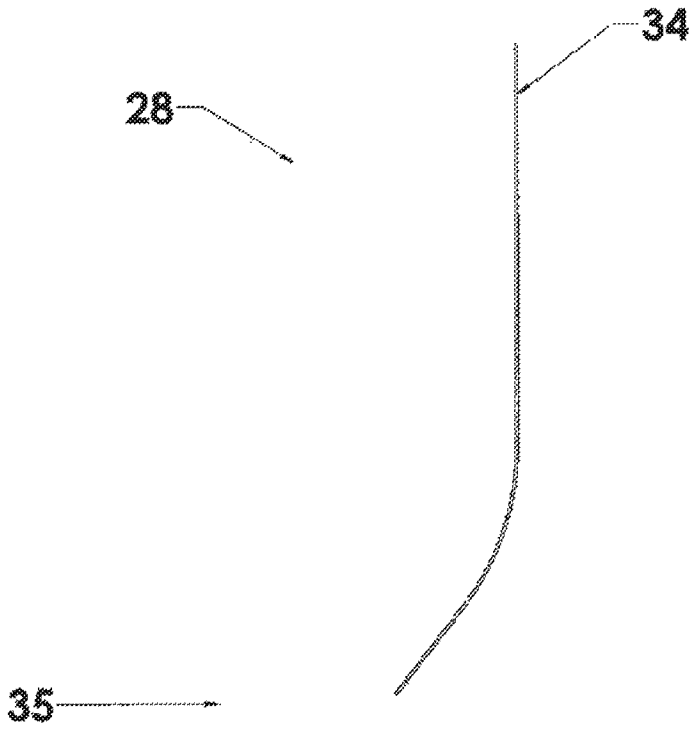
FIG. 11 is a detail view of the vertical profile of a straightening vane according to one embodiment of the present invention.

Another problem associated with mixed flow fan designs is the loss of efficiency due to radial and tangential velocity components of the primary exhaust flow exiting the impeller shroud 19. The present invention addresses this problem by providing multiple straightening guide vanes 28, which extend radially from the perimeter of the motor enclosure 23 through the annular exhaust plenum 16 to the fan housing 11. As shown in FIG. 11, the guide vanes 28 have a vertical profile which transitions from a curved leading edge 35 to a substantially axial trailing edge 34. This profile of the guide vanes 28 has the effect of diverting the primary effluent flow in the axial direction, which results in a greater volumetric flow rate and increased overall static efficiency of the fan assembly.

Figure 8:
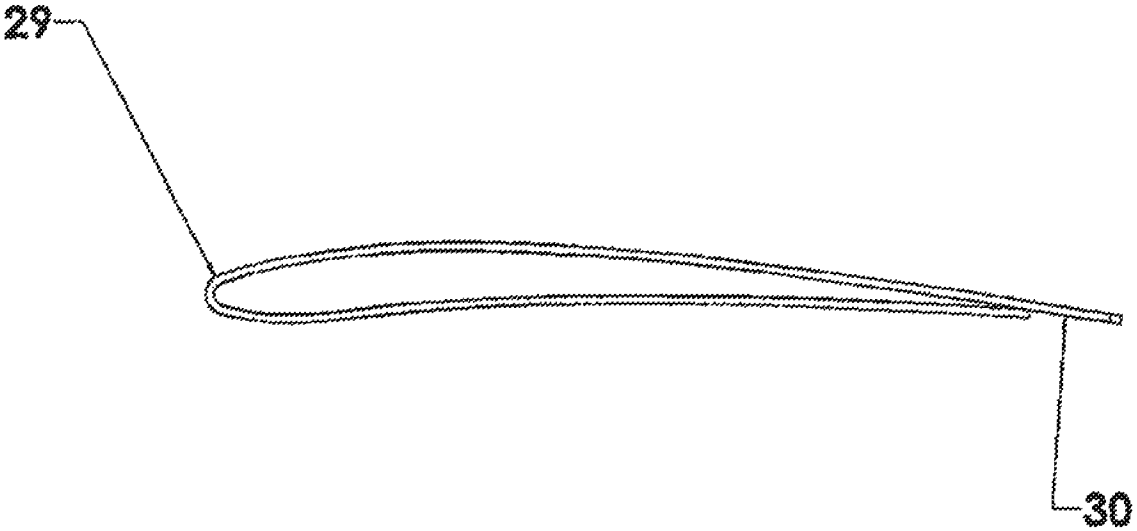
FIG. 8 is a side profile detail view of an airfoil impeller blade according to one embodiment of the present invention.
Figure 9:
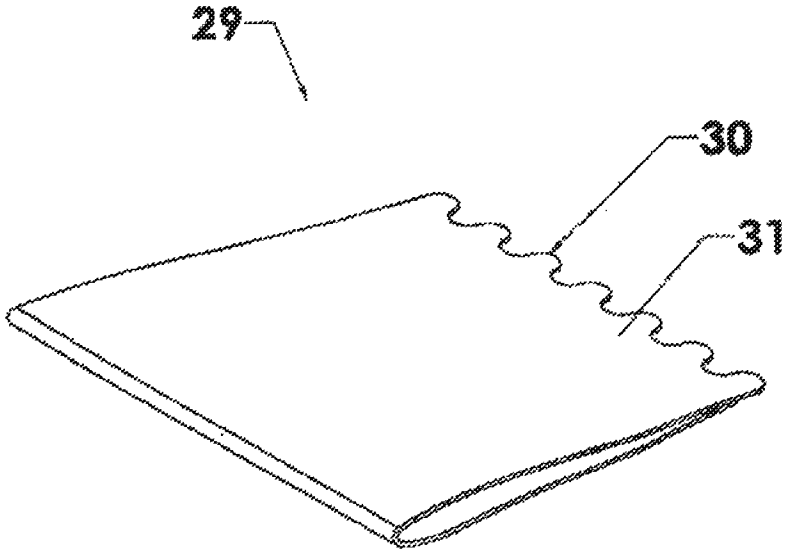
FIG. 9 is a perspective detail view of an airfoil impeller blade with a scalloped trailing edge according to one embodiment of the present invention.
Figure 10:
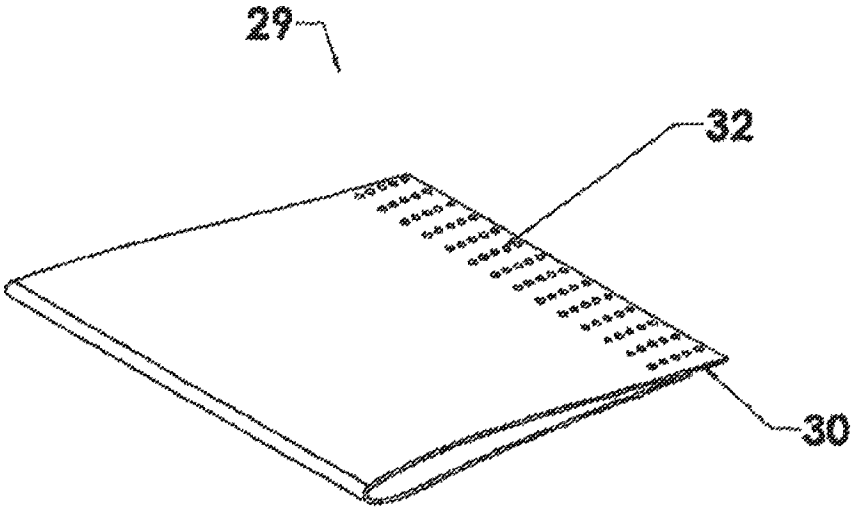
FIG. 10 is a perspective detail view of an airfoil impeller blade with a perforated trailing edge according to one embodiment of the present invention.

Referring now to FIGS. 8-10, the impeller blades 20 of this embodiment of the present invention 10 have an airfoil profile 29, with an overlap of substrate forming a single-thickness trailing edge 30. This trailing edge can be scalloped 31 and/or perforated 32, so as to attenuate operational fan noise.

Referring to FIG. 12, one embodiment of the present invention optimizes the geometry of the fan assembly to minimize exhaust gas recirculation and maximize overall efficiency.

Figure 6:
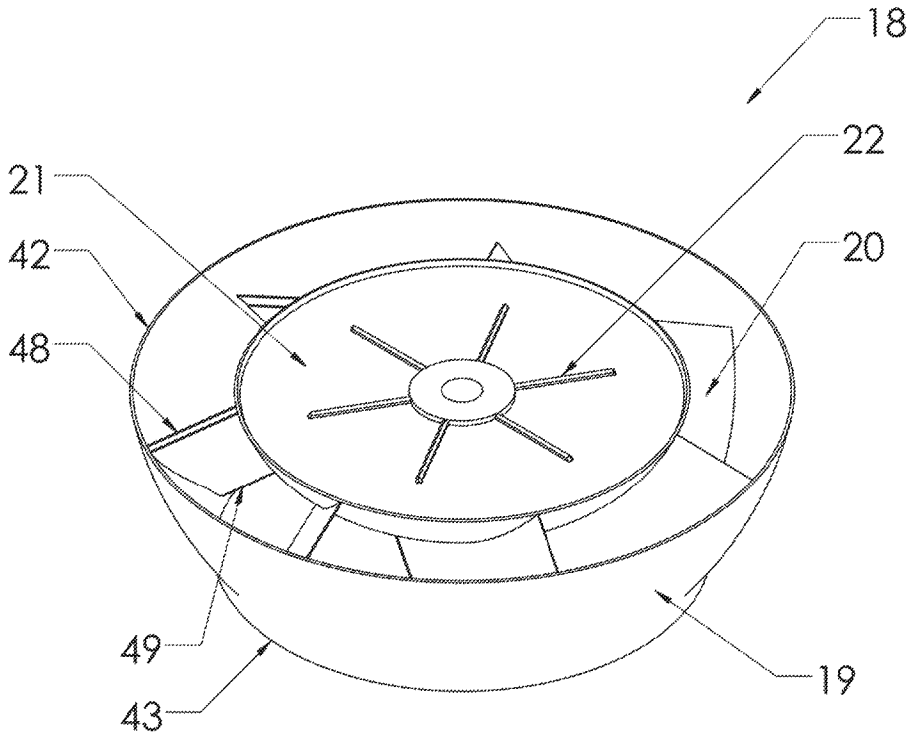
FIG. 6 is a top perspective detail view of a fan wheel with optional radial blades on the optional fan/wheel back plate according to one embodiment of the present invention.
Figure 7:
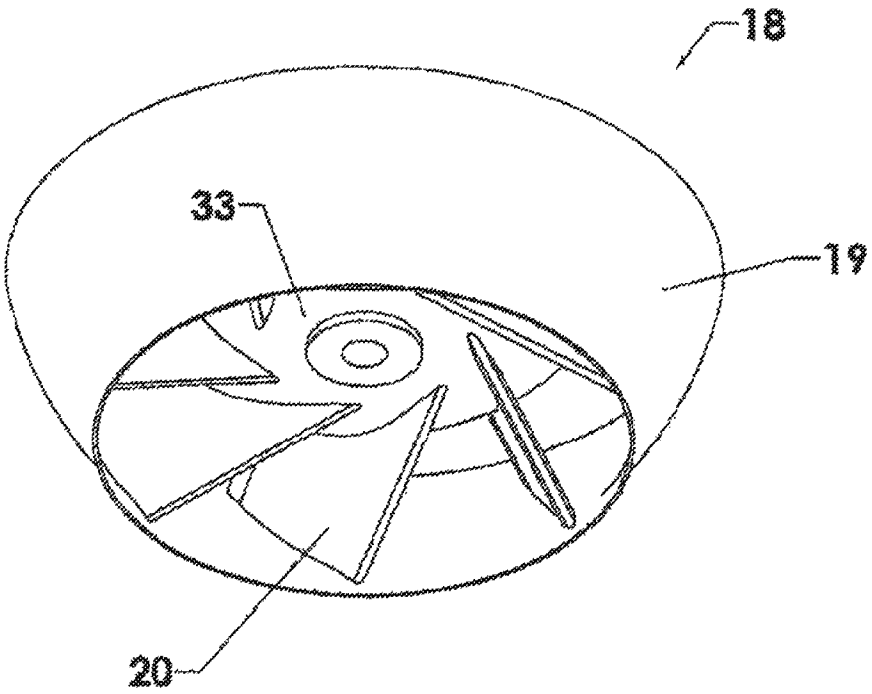
FIG. 7 is a bottom perspective detail view of a fan wheel according to one embodiment of the present invention.
Figure 15:
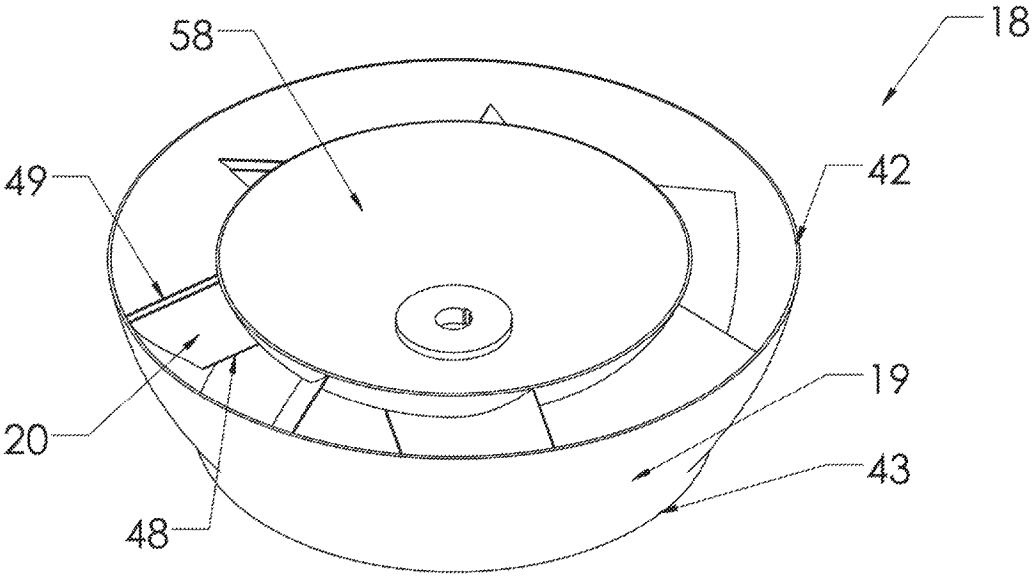
FIG. 15 is top perspective detail view of a fan wheel according to one embodiment of the present invention, in which no back plate is provided.

In this optimized configuration, the impeller shroud 19 forms an angle of 27.25° with respect to a vertical reference line through the impeller diameter (D) 40. The impeller shroud ID entry wedge 44 has a length of 0.05D. The shroud transition curvature 60 has a radius of 0.0898D which originates at the shroud curvature center 59. The impeller cone plate's radius of curvature 38 with respect to the unified metacenter 41 is in the range from 0.30D to 0.36D. It should be noted that although the embodiment depicted in FIG. 12 has a conical shroud shape, the impeller shroud 19 may be curved, as depicted in FIG. 6 and FIG. 15.

In the embodiment depicted in FIG. 12, the positions of the impeller cone plate OD edge 46 and the impeller shroud OD edge 36 are determined by a line extending from the unified metacenter 41 at an angle of 20° to the horizontal. A tangential line extended from the cone plate OD edge 46 forms an angle of 20° to the vertical, while a tangential line extended from the impeller shroud OD edge 36 forms an angle of 27.25° to the vertical. However, it should be noted that, in alternate embodiments, the cone plate OD edge 46 and the impeller shroud OD edge 36 can have a range of angular configurations, such that both features can form a minimum 0° angle with the horizontal, as depicted in FIG. 6 and FIG. 15.

The trailing edge 49 of the impeller blade/flight 20 forms an angle of 90° with the impeller shroud 19. The flight's leading edge 48 is at an angle of 45° to the horizontal and forms an angle of 72.25° with the impeller shroud 19.

The foregoing geometry defines the impeller discharge containment region 50, which provides a space within the impeller shroud 19 upstream of the guide vane area 39 where the exhaust flow can develop as it exits the impeller 18 before it enters the back plate clearance 47. This feature is created when the flight trailing edge 49 of each impeller blade 20 is recessed a prescribed distance from the impeller cone plate OD edge 46 and impeller shroud OD edge 36. Thus this discharge containment region 50 is exemplified when the impeller cone plate OD edge 46 is tangentially at an angle of 20° to the vertical and the impeller shroud OD edge 36 is tangentially at an angle of 20° to the horizontal, such as in FIG. 12, or when these angles are at their minimum range values of 0°, as depicted in FIG. 6 and FIG. 15. The impeller discharge containment area 50 facilitates containment of the flow from the impeller 18 and allows the guide vane offset 56 separating the guide vane area 39 from the impeller cone plate OD 45 to be minimized without impeding the flow. This space 50 allows the guide vanes 28 to extend as close as possible to the rotating impeller wheel 18, while providing an area for airflow to develop as it begins to discharge from the impeller 18. The guide vanes 28 can thus begin to straighten the airflow immediately as it discharges from the impeller 18 and thereby reduce energy-dissipating rotational airflow and vortices in the annular exhaust plenum 16.

In the embodiment shown in FIG. 12, the inlet bell 14 is preferably curved, with a curvature radius of 0.25D with respect to an inlet bell metacenter 53. Optionally, multiple vertical vortex breaker vanes 54, each with a length of 0.25D, can be located within the inlet bell 14 to axially straighten the flow entering the inlet bell 14.

An alternate configuration of the fan wheel/impeller 18 is depicted in FIG. 15, wherein the fan wheel back plate 21 is not present, and the reverse side of the impeller cone plate 58 is exposed.

While the embodiments depicted and described herein have a direct inline linkage between the fan motor 12 and the impeller shaft 27, it should be understood that an indirect coupling of the fan motor 12 to the impeller 18 is also within the scope of the present invention and the claims herein.

Although the preferred embodiments of the present invention have been disclosed for illustrative purposes, those skilled in the art will appreciate that many additions, modifications and substitutions are possible, without departing from the scope and spirit of the present invention and the claims herein.

What is claimed is:

1. A mixed flow fan assembly, comprising:

a fan housing, having an axial fan housing centerline, and having a top and a base that is supported on a mounting plenum, and having an upper portion that is internally divided into an axially central motor enclosure surrounded by an annular exhaust plenum, and having a lower portion that contains a fan wheel and an inlet bell;

the fan wheel, comprising a shroud, a wheel cone, and multiple impeller blades attached to both the wheel cone and the shroud, wherein each of the impeller blades has a leading edge and a trailing edge, and wherein the shroud has an inverted bell shape and has a lower end which opens into the inlet bell, and wherein the inlet bell has a substantially frustum shape and has a lower end which opens into the mounting plenum, through which an exhaust gas flow flows upward into the fan housing;

a fan motor located in the motor enclosure and rotatably coupled to the fan wheel through a motor-impeller shaft coupler, such that the fan motor imparts rotation to the fan wheel and the impeller blades, and such that the rotation of the impeller blades draws the exhaust gas flow upward through the inlet bell and the shroud and accelerates the exhaust gas flow upward into the annular exhaust plenum, from which an exhaust gas flow is discharged through the top of the fan housing;

wherein multiple guide vanes are radially disposed within the annular exhaust plenum at a guide vane offset from the fan wheel, and wherein the guide vanes have a vertical profile which transitions from a lower curved leading edge to an upper substantially axial trailing edge, and wherein the guide vanes divert the exhaust gas flow in the axial direction, and increase the volumetric flow of the exhaust gas flow, thereby increasing the static efficiency of the mixed flow fan assembly; and wherein one or more inlet openings are located between the base of the fan housing and the mounting plenum, and wherein a first ambient air flow is induced through the inlet openings by a venturi effect of the exhaust gas flow expelled from the shroud of the fan wheel, and wherein the aforesaid venturi effect draws the first ambient air flow through the lower portion of the fan housing and into an area of a low pressure generated by the exhaust gas flow expelled from the shroud and surrounding the shroud and the inlet bell, and wherein the first ambient air flow around the shroud and the inlet bell offsets the low pressure generated by the exhaust gas flow expelled from the shroud, thereby reducing an efficiency loss caused by a recirculation of the exhaust gas flow within the fan wheel, and thereby increasing volumetric flow rate through the fan wheel.

2. The mixed flow fan assembly of claim 1, wherein the shroud has an impeller shroud outer diameter edge and the wheel cone has an impeller cone outer diameter edge, and wherein a line drawn between the impeller shroud outer diameter edge and the impeller cone OD outer diameter edge forms a containment angle with respect to a horizontal reference line perpendicular to the fan housing centerline, and wherein the containment angle, when rotated through a full circle around the fan housing centerline, defines a conical or planar containment boundary, and wherein a rotational locus of the trailing edges of the impeller blades about the fan housing centerline defines a conical blade boundary, and wherein an area between the shroud and the wheel cone and between the containment boundary and the blade boundary constitutes a discharge containment region, through which the exhaust gas flow passes before entering the annular exhaust plenum, thereby allowing the guide vane offset to be reduced without interfering with the exhaust gas flow.

3. The mixed flow fan assembly of claim 2, wherein the containment angle is in a range from 0 to 20 degrees.

4. The mixed flow fan assembly of claim 3, wherein the containment angle is 20 degrees.

5. The mixed flow fan assembly of claim 3, wherein a tangential line at the impeller cone outer diameter edge forms an angle in the range of 0 to 20 degrees with respect to a vertical reference line parallel to the fan housing centerline.

6. The mixed flow fan assembly of claim 4, wherein a tangential line at the impeller cone outer diameter edge forms an angle of 20 degrees with respect to a vertical reference line parallel to the fan housing centerline.

7. The mixed flow fan assembly of claim 5, wherein the trailing edge of each impeller blade forms an angle of 90 degrees with the shroud.

8. The mixed flow fan assembly of claim 7, wherein the leading edge of each impeller blade forms an angle of 45 degrees to a horizontal reference line perpendicular to the fan housing centerline.

9. The mixed flow fan assembly of claim 7, wherein the leading edge of each impeller blade forms an angle of 72.25 degrees with the shroud.

10. The mixed flow fan assembly of claim 5, wherein the wheel cone has an impeller cone plate with a radius of curvature in the range of 0.30D to 0.36D, where "D" is an impeller diameter.

11. The mixed flow fan assembly of claim 10, wherein the inlet bell has a radius of curvature of 0.25D, where "D" is the impeller diameter.

12. The mixed flow fan assembly of claim 10, wherein the impeller cone plate has a radius of curvature of 0.30D.

13. The mixed flow fan assembly of any one of claims 1-12, wherein the motor enclosure has a bottom that opens into the lower portion of the fan housing, and wherein a multi-purpose port accesses the motor enclosure from outside the fan housing through the exhaust plenum, and wherein the fan wheel further comprises a back plate, and wherein the back plate of the fan wheel has multiple back plate blades, such that rotation of the back plate blades draws a second ambient air flow through the multi-purpose port into the motor enclosure and down into the fan wheel, and wherein the first ambient air flow cools the fan motor, and wherein the second ambient air flow maintains a positive pressure in the motor enclosure so as to pneumatically segregate the fan motor from the exhaust gas flow through the annular exhaust plenum, and wherein the flow of the second ambient air flow into the fan wheel dilutes the exhaust gas flow and causes the exhaust gas flow to be expelled from the shroud with an increased volumetric flow rate, thereby increasing the static efficiency of the mixed flow fan assembly.

* * * * *